US012655989B2

(12) United States Patent
Bernauer et al.

(10) Patent No.: US 12,655,989 B2
(45) Date of Patent: Jun. 16, 2026

(54) DOOR AND DOMESTIC COOKING DEVICE

(71) Applicant: BSH Hausgeräte GmbH, Munich (DE)

(72) Inventors: Maximilian Bernauer, Kienberg (DE); Frederic Dubois, Trostberg (DE); Wolfgang Hörner, Traunstein (DE); Peter Jell, Breitbrunn (DE); Anja Schueck, Traunreut (DE); Christine Thaller, Waging (DE)

(73) Assignee: BSH Hausgeräte GmbH, Munich (DE)

( * ) Notice: Subject to any disclaimer, the term of this patent is extended or adjusted under 35 U.S.C. 154(b) by 582 days.

(21) Appl. No.: 17/928,290

(22) PCT Filed: Jul. 7, 2021

(86) PCT No.: PCT/EP2021/068837
§ 371 (c)(1),
(2) Date: Nov. 29, 2022

(87) PCT Pub. No.: WO2022/017794
PCT Pub. Date: Jan. 27, 2022

(65) Prior Publication Data

US 2023/0296260 A1 Sep. 21, 2023

(30) Foreign Application Priority Data

Jul. 22, 2020 (DE) ..... 10 2020 209 245.1

(51) Int. Cl.
*F24C 15/02* (2006.01)
*F24C 15/14* (2006.01)

(52) U.S. Cl.
CPC ..... *F24C 15/021* (2013.01); *F24C 15/14* (2013.01)

(58) Field of Classification Search
CPC ..... F24C 15/045; F24C 15/14; F24C 15/021
USPC ..... 126/190, 198, 200
See application file for complete search history.

(56) References Cited

U.S. PATENT DOCUMENTS 4,541,203 A * 9/1985 Naffrechoux ..... F24C 15/04 126/200
2013/0319393 A1* 12/2013 Harward ..... F24C 15/04 126/190
2019/0257526 A1* 8/2019 Streitwieser ..... F24C 15/02
(Continued)

FOREIGN PATENT DOCUMENTS

DE 102005024426 A1 11/2006
DE 102014223551 A1 * 5/2016 ..... F24C 15/026
DE 102016224305 A1 * 6/2018 ..... F24C 15/14
(Continued)

OTHER PUBLICATIONS

Machine Translation of DE 102014223551 (Year: 2016).*
(Continued)

*Primary Examiner* — Allen R. B. Schult
*Assistant Examiner* — Amy E Carter
(74) *Attorney, Agent, or Firm* — Michael E. Tschupp; Andre Pallapies; Brandon G. Braun

(57) ABSTRACT

A door for a household cooking appliance includes an outer pane, an inner pane, a condensate collecting strip provided on a lower edge of the door for collecting a liquid condensed on the inner pane, and a seal element arranged at least in one portion in a gap between the outer pane and the inner pane. The seal element is exclusively connected to the condensate collecting strip.

20 Claims, 16 Drawing Sheets

(56) References Cited

U.S. PATENT DOCUMENTS

2020/0300477 A1 9/2020 Dinkel

FOREIGN PATENT DOCUMENTS

| | | | | |
|---|---|---|---|---|
| DE | 102016224708 | A1 * | 6/2018 | ..... F24C 15/02 |
| DE | 102017220151 | A1 * | 5/2019 | ..... F24C 15/021 |
| GB | 2063463 | A | 6/1981 | |
| WO | 2012029768 | A1 | 3/2012 | |
| WO | WO-2012089460 | A1 * | 7/2012 | ..... F24C 15/14 |

OTHER PUBLICATIONS

Machine Translation of DE 102016224305 (Year: 2018).*
Machine Translation of DE 102016224708 (Year: 2018).*
DE 102017220151 with Machine Translation (Year: 2019).*
National Search Report DE 102020209245.1 dated Mar. 15, 2021.
International Search Report PCT/EP2021/068837 dated Sep. 17, 2021.
National Search Report CN 202180060543.0 dated Aug. 19, 2025.

* cited by examiner

DOOR AND DOMESTIC COOKING DEVICE

CROSS-REFERENCES TO RELATED APPLICATIONS

This application is the U.S. National Stage of International Application No. PCT/EP2021/068837, filed Jul. 7, 2021, which designated the United States and has been published as International Publication No. WO 2022/017794 A1 and which claims the priority of German Patent Application, Serial No. 10 2020 209 245.1, filed Jul. 22, 2020, pursuant to 35 U.S.C. 119(a)-(d).

The contents of International Application No. PCT/EP2021/068837 and German Patent Application, Serial No. 10 2020 209 245.1 are incorporated herein by reference in their entireties as if fully set forth herein.

The present invention relates to a door for a household cooking appliance and a household cooking appliance comprising such a door.

A household cooking appliance can have a cooking chamber comprising a door which is pivotably attached to the cooking chamber. The door can have an inner pane facing the cooking chamber, an outer pane facing away from the cooking chamber and an intermediate pane arranged between the inner pane and the outer pane. A seal element can be arranged between the intermediate pane and the inner pane, said seal element sealing a gap arranged between the intermediate pane and the inner pane. As a result, a thermally insulating air cushion can be produced between the inner pane and the intermediate pane. The seal element can be hooked, for example, between two door supports of the door.

BRIEF SUMMARY OF THE INVENTION

Against this background, it is an object of the present invention to provide an improved door for a household cooking appliance.

Accordingly, a door for a household cooking appliance is proposed. The door comprises an outer pane, an inner pane, a condensate collecting strip which is provided on a lower edge of the door for collecting a liquid condensed on the inner pane, and a seal element which is arranged at least in some portions in a gap provided between the outer pane and the inner pane, wherein the seal element is exclusively connected to the condensate collecting strip.

As the seal element is connected only or exclusively to the condensate collecting strip, it is possible to dispense with the seal element being hooked, for example, onto the door supports or other components of the door. The seal element can be mounted together with the condensate collecting strip. It is not possible to mount the seal element incorrectly.

The household cooking appliance can be a stove, an oven, a microwave combination oven, a double oven, or the like. Preferably, the household cooking appliance comprises a cooking chamber to which the door is pivotably attached. Hinges can be provided therefor. The hinges can be coupled to door supports of the door. However, this is not absolutely necessary. Alternatively, the door can also be arranged on an oven carriage or the like, which can be pulled out of the cooking chamber. In this case, the door is not pivotably attached to the cooking chamber but is displaceable relative thereto in a linear manner.

Preferably, the door comprises in addition to the outer pane and the inner pane a plurality of intermediate panes arranged between the outer pane and the inner pane. Preferably, the door supports are fixedly connected to the outer pane. For example, the door supports are adhesively bonded to the outer pane. Alternatively, the door supports can also be releasably connected to the outer pane. The door supports are attached to the outer pane at the side and when the door is closed run in a y-direction or vertical direction of the household cooking appliance or the door.

The door is able to be dismounted from the cooking chamber so that the door can be dismantled and reassembled in its state dismounted from the cooking chamber. Moreover, the door can also be dismantled and reassembled in a state mounted on the cooking chamber. The outer pane, the inner pane and the intermediate panes are preferably transparent at least in some portions. In principle there can be any number of intermediate panes. For example, one intermediate pane can be provided. However, two intermediate panes or three intermediate panes can also be provided. The intermediate pane or the intermediate panes can be produced from glass, a sol-gel, a polycarbonate, or the like. Alternatively, the intermediate pane or the intermediate panes can be configured as a screen made of metal, non-ferrous metal or plastics.

The condensate collecting strip is channel-shaped or trough-shaped. For example, when the door is opened and closed, the condensed liquid in the form of droplets trickles downwardly on the inner pane into the condensate collecting strip. The liquid can be, for example, water or vapors. The seal element seals the gap such that a stationary air cushion is provided in the gap. This improves the thermal insulation properties of the door. As a result, the energy efficiency of the household cooking appliance is increased. In the present case, the seal element "exclusively" or "only" being connected to the condensate collecting strip means that the seal element is not connected to any other component of the door apart from the condensate collecting strip. In particular, the seal element is not hooked into the door supports.

According to one embodiment, the seal element is connected by a positive, non-positive and/or material connection to the condensate collecting strip.

A positive connection is produced by at least two connection partners, in the present case the condensate collecting strip and the seal element, engaging in one another or behind one another. Positive connections are separable connections. A non-positive connection requires a normal force on the surfaces to be connected together. Non-positive connections can be implemented by a frictional connection. The mutual displacement of the surfaces is prevented as long as the counter-force brought about by the static friction is not exceeded. In the case of material connections, the connection partners are held together by atomic or molecular forces. Material connections are non-releasable connections which can be separated only by destroying the connection means and/or the connection partners. A material connection can be made, for example, by adhesive bonding or vulcanizing.

According to a further embodiment, the seal element comprises an engagement portion which positively engages in a corresponding counter-engagement portion of the condensate collecting strip.

The engagement portion can have, for example, a T-shaped geometry which is received in a corresponding counter-engagement portion in the form of a groove. The engagement portion and the counter-engagement portion can comprise any projections, recesses, bores, ribs or the like.

According to a further embodiment, the seal element is hooked into the condensate collecting strip at the side.

Preferably, at its ends the seal element comprises hooks which are hooked into the condensate collecting strip. The hooks can be adhesively bonded to the seal element.

According to a further embodiment, the seal element is injection-molded onto the condensate collecting strip by means of a multi-component injection-molding method.

This facilitates the production of the seal element and the condensate collecting strip. The seal element is preferably formed by a flexible component and the condensate collecting strip is formed by a hard component. The flexible component can comprise, for example, a thermoplastic elastomer (TPE), in particular a thermoplastic polyurethane (TPU). The hard component can comprise, for example, an acrylonitrile butadiene styrene (ABS). The seal element can also be produced from silicone. Moreover, the seal element can be produced from glass fiber, in particular from a glass fiber tube. The seal element can also be an elastically deformable metal sheet.

According to a further embodiment, the condensate collecting strip supports the seal element over the entire length thereof.

In particular, the seal element is connected over its entire length to the condensate collecting strip. As a result, the seal element can be reliably prevented from sagging. Moreover, it is also not necessary to pretension the seal element.

According to a further embodiment, the door further comprises an intermediate pane which is arranged between the outer pane and the inner pane, wherein the gap is provided between the intermediate pane and the inner pane.

As mentioned above, there can be any number of intermediate panes. For example, two or three intermediate panes are provided. Moreover, exactly one intermediate pane can be provided.

According to a further embodiment, the door further comprises a first intermediate pane and a second intermediate pane, which are arranged between the outer pane and the inner pane, wherein the first intermediate pane is arranged between the outer pane and the second intermediate pane, wherein the second intermediate pane is arranged between the inner pane and the first intermediate pane, and wherein the gap is provided between the second intermediate pane and the inner pane.

Preferably, a gap is also provided between the outer pane and the first intermediate pane and between the first intermediate pane and the second intermediate pane. These gaps, however, are ventilated so that an airflow can flow through the door between the outer pane and the first intermediate pane and between the first intermediate pane and the second intermediate pane.

According to a further embodiment, the seal element is pressed between the inner pane and the second intermediate pane.

In other words, the seal element is elastically deformed. The seal element bears both against the inner pane and against the second intermediate pane.

According to a further embodiment, the door further comprises at least one door support which bears the outer pane, wherein the condensate collecting strip is positively connected to the at least one door support.

Preferably, two door supports are provided. However, exactly one door support, for example in the form of a frame, can be provided.

According to a further embodiment, the door further comprises a first door support and a second door support, wherein the condensate collecting strip is arranged between the first door support and the second door support.

The condensate collecting strip is positively connected both to the first door support and to the second door support. The first door support and the second door support can be adhesively bonded to the outer pane. However, the first door support and the second door support can be connected to the outer pane in any other manner.

According to a further embodiment, the condensate collecting strip comprises a snap hook which positively engages in the at least one door support.

This permits a secure retention of the condensate collecting strip on the door supports. Preferably, the condensate collecting strip comprises in each case a snap hook on the end side, wherein one of the snap hooks is assigned to each door support. The snap hooks are resiliently deformable. Preferably, the snap hooks snap into an engagement portion, for example in the form of a recess, a projection or a rib, provided on the respective door support.

According to a further embodiment, the snap hook comprises an elastically deformable leaf spring portion.

Tolerance compensation is possible by means of the leaf spring portion. Moreover, the leaf spring portion serves for centering the condensate collecting strip on the door supports.

According to a further embodiment, the condensate collecting strip comprises an articulated head about which the condensate collecting strip is pivotably mounted on the at least one door support so that the condensate collecting strip is pivotable from an unlocked state, in which the snap hook is not positively engaged with the at least one door support, into a locked state in which the snap hook is positively engaged with the at least one door support.

The articulated head is received in a corresponding recess of the respective door support. In the unlocked state, the condensate collecting strip can be separated from the door. In the locked state, the condensate collecting strip can be separated from the door only by the snap hooks of the condensate collecting strip being elastically deformed such that these snap hooks are brought out of positive engagement with the respective door support.

Moreover, a household cooking appliance comprising a cooking chamber and such a door attached to the cooking chamber is proposed.

The household cooking appliance, as mentioned above, can be a stove, an oven, a microwave combination oven, a double oven, or the like. "Attached" in the present case means that the door is connected to the cooking chamber, for example, so as to be vertically or horizontally pivotable. Alternatively, the door can also be arranged on an oven carriage which can be extended out of the cooking chamber. In this case, the door is not pivotably mounted on the cooking chamber but is displaceable or movable relative thereto in a linear manner. However, the door can also perform any movement when opened.

Further possible implementations of the door and/or the household cooking appliance also comprise not explicitly mentioned combinations of features or embodiments described above or below relative to the exemplary embodiments. In this case, the person skilled in the art will also add individual aspects as improvements or additions to the respective basic form of the door and/or the household cooking appliance.

BRIEF DESCRIPTION OF THE DRAWINGS

Further advantageous embodiments and aspects of the door and/or the household cooking appliance form the subject matter of the subclaims and the exemplary embodiments of the door and/or the household cooking appliance described below. The door and/or the household cooking appliance are explained in more detail hereinafter by way of preferred embodiments with reference to the accompanying figures.

DETAILED DESCRIPTION OF EXEMPLARY EMBODIMENTS OF THE PRESENT INVENTION

Elements which are the same or functionally the same have been provided with the same reference signs in the figures, unless specified otherwise.

Figure 1:
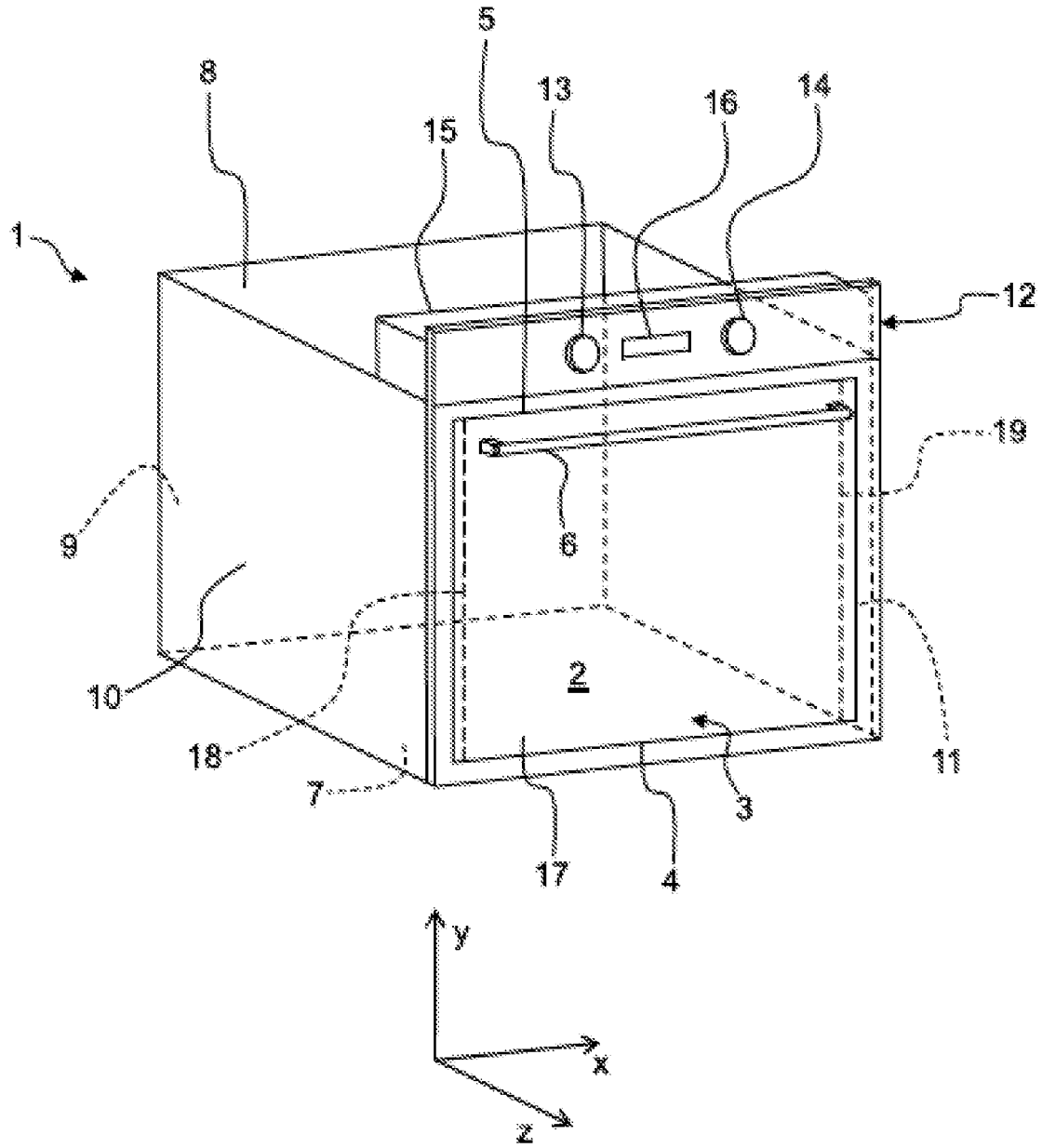
FIG. 1 shows a schematic perspective view of an embodiment of a household cooking appliance.

FIG. 1 shows a schematic perspective view of an embodiment of a household cooking appliance 1. The household cooking appliance 1 can be a stove, an oven, a microwave combination oven, a double oven or the like. The household cooking appliance 1 has a cooking chamber 2 which can be closed by means of a door 3. The cooking chamber 2 can also be denoted as a muffle or oven muffle. The cooking chamber 2 can be arranged in the interior of a housing of the household cooking appliance 1. The door 3 is shown in FIG. 1 in a closed position. The door 3 can be closed or opened by pivoting about a pivot axis provided at a lower end of the door 3 or a lower edge 4 of the door 3. Alternatively, the door 3 can be attached to the cooking chamber 2 at the side. Moreover, the door 3 can be arranged on an oven carriage which can be pulled out of the cooking chamber 2. However, it is possible to select any type of movement of the door 3 when the door 3 is opened. In other words, in principle the door 3 can perform any movement when opened.

A handle 6 can be provided on an upper portion or on an upper edge 5 of the door 3. However, the door 3 can also be without a handle. The cooking chamber 2 has a bottom 7, a ceiling 8 arranged opposite the bottom 7, a rear wall 9 arranged opposite the closed door 3 and two side walls 10, 11 arranged opposite one another. The cooking chamber 2 is preferably cuboidal or cube-shaped. The cooking chamber 2 can be produced from a metal material, in particular from sheet steel.

The household cooking appliance 1 also comprises control knobs 13, 14 provided on a switch panel or control panel 12. The control knobs 13, 14 can be, for example, rotatable. A control facility 15, only shown schematically, can be provided on the rear face on the control panel 12 for controlling the household cooking appliance 1. The control facility 15 can be a regulating facility and/or control facility. A display 16 can also be provided on the control panel 12. An operating state of the household cooking appliance 1 can be displayed by means of the display 16. For example, a temperature set by means of the control knobs 13, 14 can be displayed by means of the display 16.

The household cooking appliance 1 can be capable of pyrolysis. In other words, the cooking chamber 2 can be burnt out by means of a correspondingly high temperature. Dirt adhering to the cooking chamber 2 and to the door 3 on the inner face is carbonized thereby, so that this dirt either drops off automatically or can be easily removed. However, this pyrolysis function is not absolutely necessary. The door 3 is a ventilated door. In other words, an air flow is conducted through the door 3.

A coordinate system having a width direction or x-direction x, a vertical direction or y-direction y, and a depth direction or z-direction z is assigned to the household cooking appliance 1 or the door 3. The directions x, y, z are oriented perpendicular to one another. The door 3 comprises an outer pane 17 which is located in a plane spanned by the x-direction x and the y-direction y. On the rear face, i.e. facing the cooking chamber 2, a first door support 18 and a second door support 19 are attached to the outer pane 17. When the door 3 is closed, the door supports 18, 19 run in the y-direction y. The door supports 18, 19 are preferably adhesively bonded to the outer pane 17 on the rear face. The door supports 18, 19 can be connected, however, in any other manner to the outer pane 17. For example, the door supports 18, 19 are hooked into the outer pane 17. The door supports 18, 19 are produced from a plastics material. Hinges, not shown, can be attached to the door supports 18, 19 so that the door 3 can be pivotably attached to the cooking chamber 2.

Figure 2:
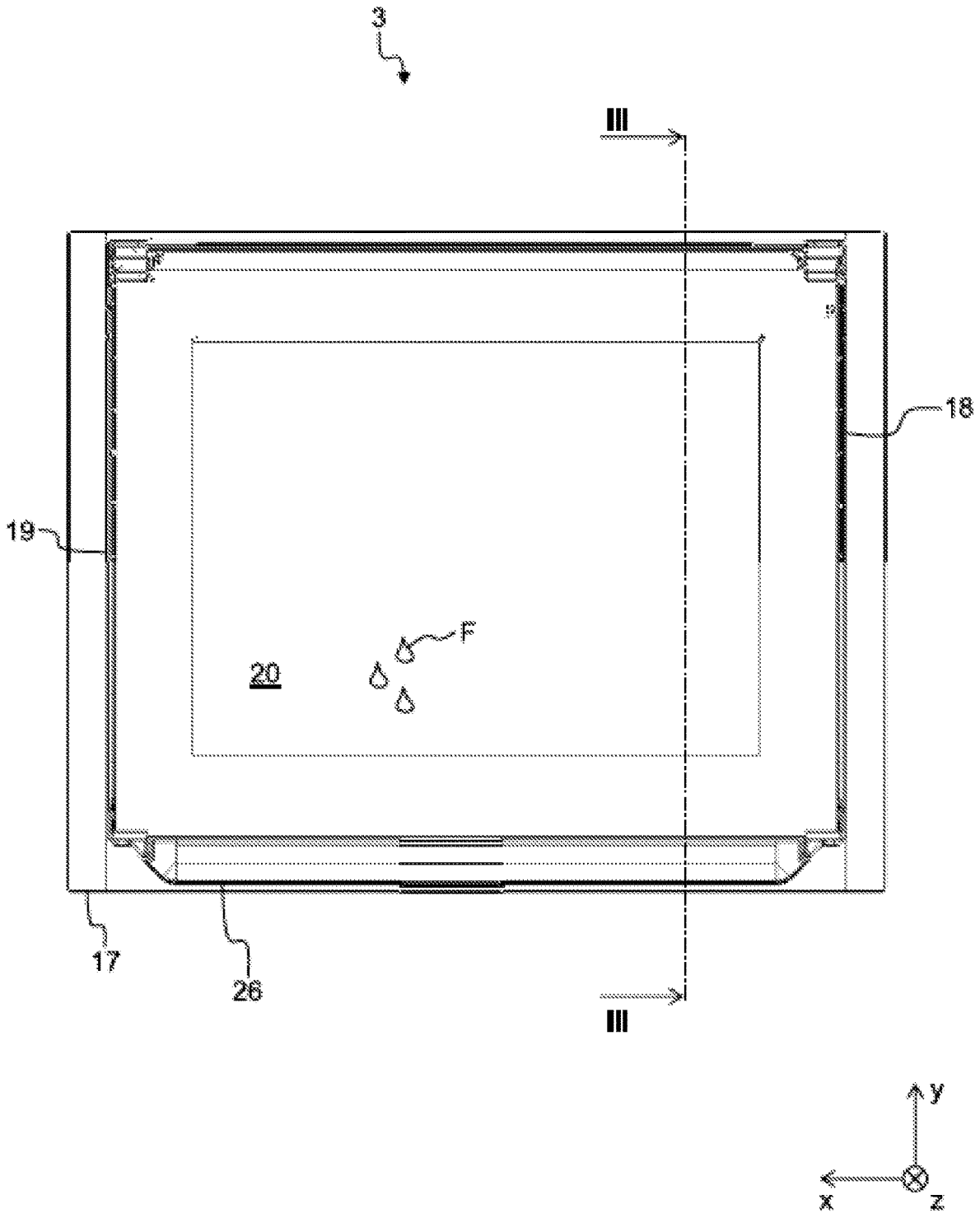
FIG. 2 shows a schematic plan view of an embodiment of a door for the household cooking appliance according to FIG. 1.
Figure 3:
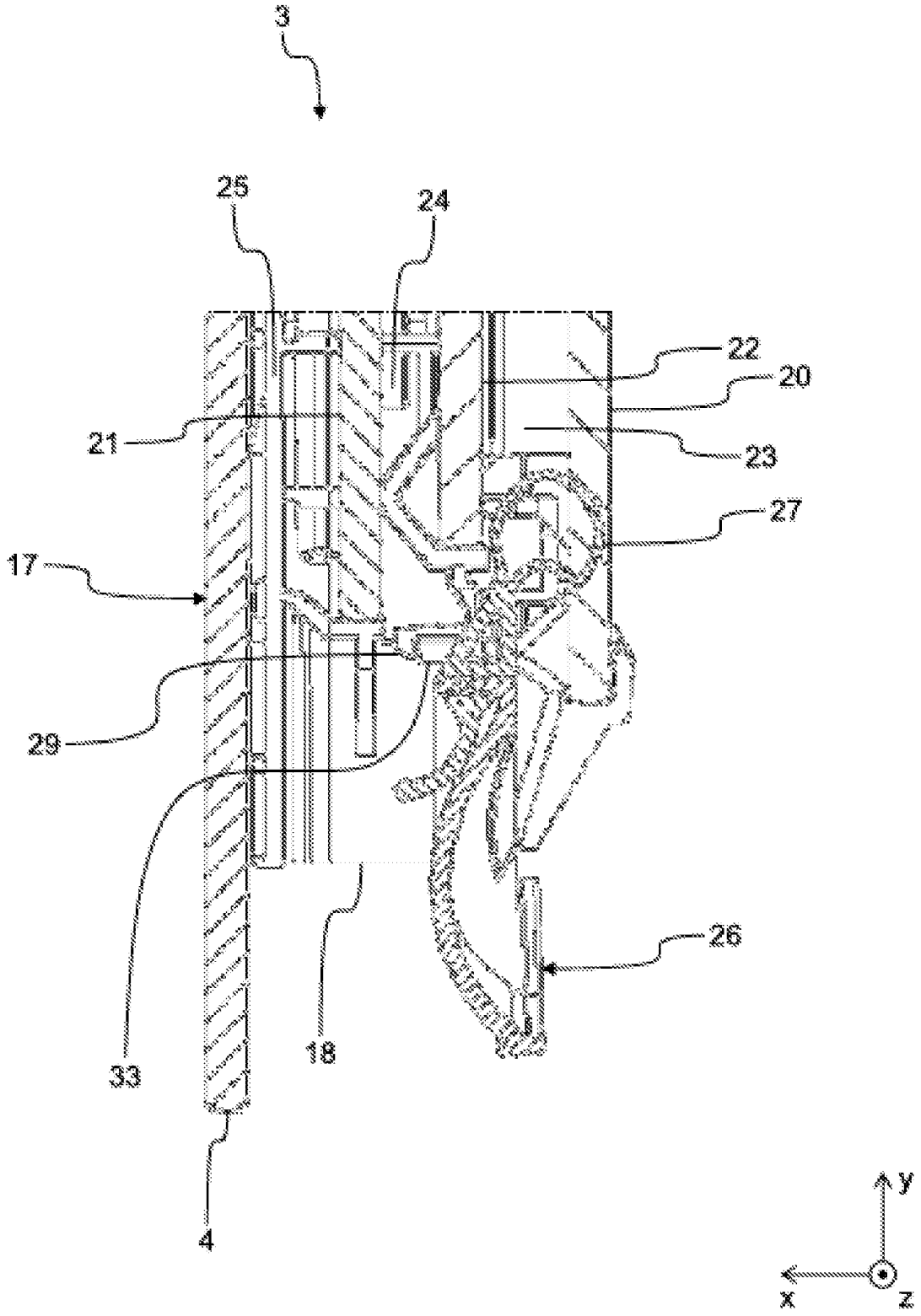
FIG. 3 shows a schematic sectional view of the door according to the cutting line III-III of FIG. 2.

FIG. 2 shows a schematic plan view of an embodiment of a door 3 as mentioned above, with a viewing direction from the cooking chamber 2 in the direction of the door 3. FIG. 3 shows a sectional view of the door 3 according to the cutting line III-III of FIG. 2. Reference is made to FIGS. 2 and 3 hereinafter at the same time.

As mentioned above, the door 3 comprises the outer pane 17, the door supports 18, 19 being adhesively bonded thereto on the rear face. The door supports 18, 19, however, can be connected in any other manner to the outer pane 17. In addition to the outer pane 17, the door 3 comprises an inner pane 20 facing the cooking chamber 2. A first intermediate pane 21 and a second intermediate pane 22 can be provided between the outer pane 17 and the inner pane 20. In principle, there can be any number of intermediate panes 21, 22. Just one intermediate pane 21, 22 can be also provided.

The first intermediate pane 21 is arranged closer to the outer pane 17 than the second intermediate pane 22. Accordingly, the second intermediate pane 22 is arranged closer to the inner pane 20 than the first intermediate pane 21. In particular, the first intermediate pane 21 is arranged between the outer pane 17 and the second intermediate pane 22. The second intermediate pane 22 is arranged between the first intermediate pane 21 and the inner pane 20. The intermediate panes 21, 22 can be produced from glass, a sol gel, a polycarbonate or the like. Alternatively, the intermediate panes 21, 22 can be configured as a screen made of metal, non-ferrous metal or plastics.

The door supports 18, 19 are arranged between the outer pane 17 and the inner pane 20. The door supports 18, 19 can bear or carry the intermediate panes 21, 22 and the inner pane 20, so that the outer pane 17, the inner pane 20 and the intermediate panes 21, 22 are arranged substantially parallel to one another and spaced apart from one another. An intermediate space or gap 23 is provided between the inner pane 20 and the second intermediate pane 22. An intermediate space or gap 24 is also provided between the second intermediate pane 22 and the first intermediate pane 21. Moreover, an intermediate space or gap 25 is provided between the first intermediate pane 21 and the outer pane 17.

During the operation of the household cooking appliance 1, in particular in pyrolysis mode, air can circulate between the outer pane 17 and the first intermediate pane 21. In other words, air flows through the gap 25. Air also circulates between the first intermediate pane 21 and the second intermediate pane 22, so that air also flows through the gap 24. A stationary air cushion is provided in the gap 23 between the second intermediate pane 22 and the inner pane 20. This serves for thermal insulation. Dirt can be deposited on the intermediate panes 21, 22, the inner pane 20 and/or the outer pane 17. Thus a user can remove the inner pane 20 and the intermediate panes 21, 22 from the door 3 for cleaning.

A condensate collecting strip 26 for collecting a liquid F condensed on the inner pane 20 is provided between the door supports 18, 19, i.e. running in the x-direction x. The liquid F can be, for example, water or vapors. The liquid F in the form of droplets runs along downwardly counter to the y-direction y and collects in the condensate collecting strip 26. The condensate collecting strip 26 is positively connected to the first door support 18 and to the second door support 19. A positive connection is produced by the engagement of two connection partners in one another or behind one another. A positive connection can be released again without damaging the connection partners. The condensate collecting strip 26 is provided in the region of the lower edge 4 of the door 3.

In order to generate a stationary air cushion in the gap 23, a seal element 27 which is arranged in the gap 23 is provided. The seal element 27—in contrast to that shown in FIG. 3—is pressed between the second intermediate pane 22 and the inner pane 20. The seal element 27 can be produced from, for example, silicone, glass fiber, in particular from a glass fiber tube and/or metal. The seal element 27 runs in the x-direction x and preferably extends over the entire width of the door 3.

In this case, the seal element 27 is connected exclusively or only to the condensate collecting strip 26. In the present case, "exclusively" or "only" means that the seal element 27 is not connected to one of the panes 17, 20, 21, 22, one of the door supports 18, 19 or any other component of the door 3 apart from the condensate collecting strip 26. In other words, the condensate collecting strip 26 bears the seal element 27. The seal element 27 can be connected over its entire length to the condensate collecting strip 26. However, this is not absolutely necessary. The seal element 27 can also be hooked into the condensate collecting strip 26 at the side.

At the same time, the seal element 27 is connected by a positive, non-positive and/or material connection to the condensate collecting strip 26. A non-positive connection requires a normal force onto the surfaces to be connected together. Non-positive connections can be implemented by a frictional connection. The mutual displacement of the surfaces is prevented as long as the counter-force brought about by the static friction is not exceeded. In the case of material connections, the connection partners are held together by atomic or molecular forces. Material connections are non-releasable connections which can be separated again only by destroying the connection means and/or the connection partners. A material connection can be made, for example, by adhesive bonding or vulcanizing. A material connection can also be produced by means of a multi-component injection-molding method, in which the seal element 27 is injection-molded onto the condensate collecting strip 26 or vice-versa.

Figure 4:
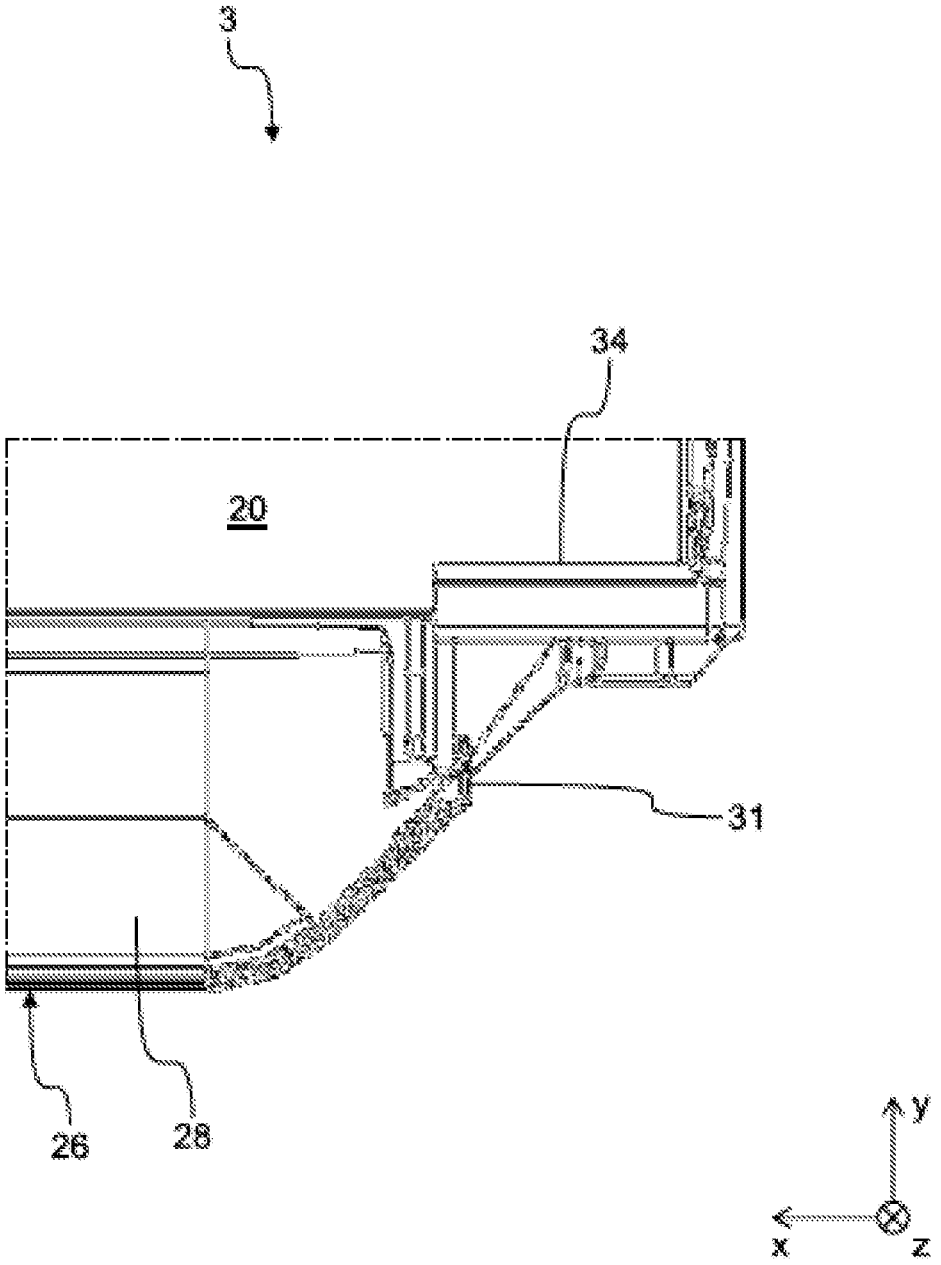
FIG. 4 shows a schematic partial view of the door according to FIG. 2.
Figure 5:
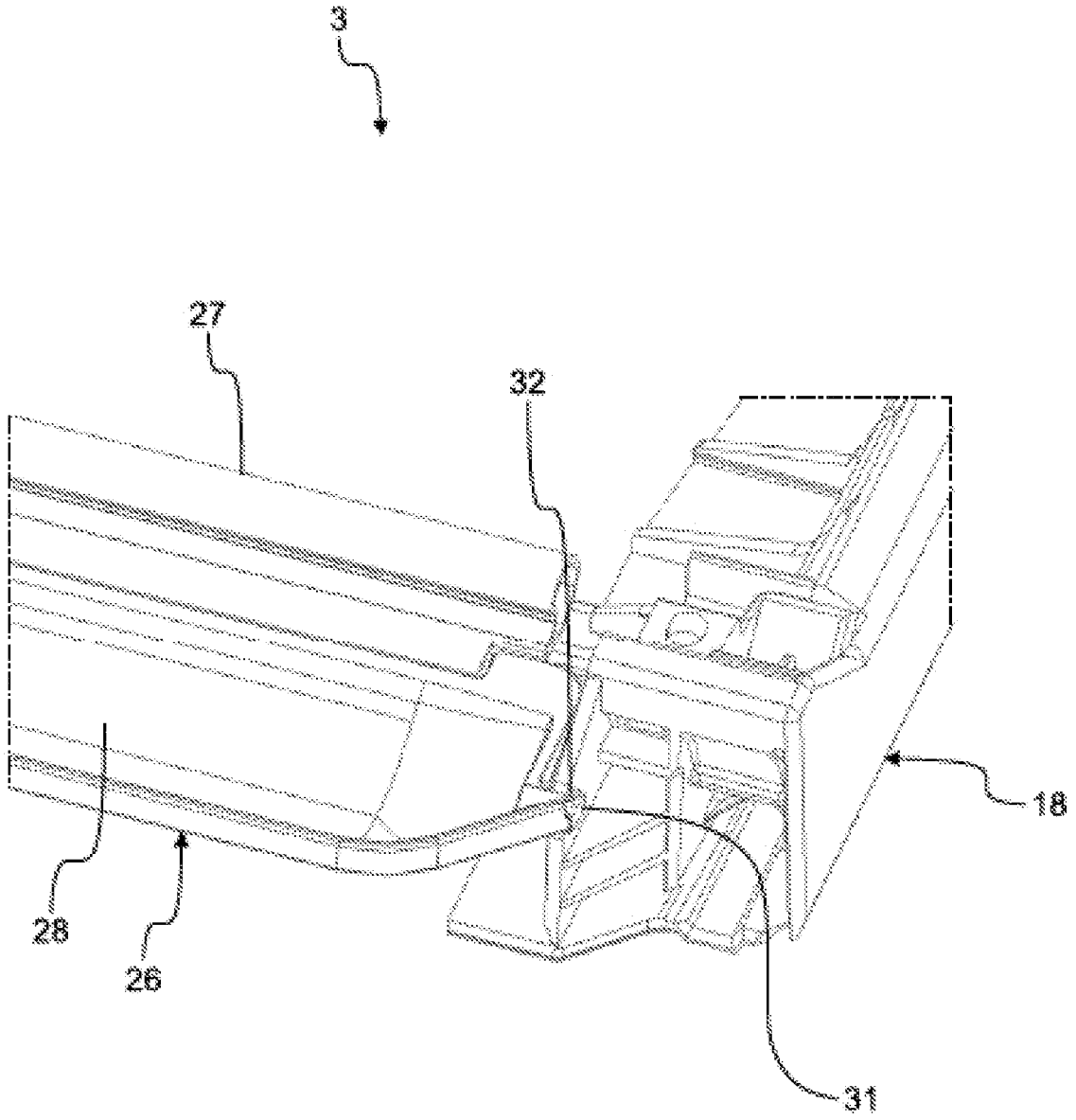
FIG. 5 shows a schematic perspective partial view of the door according to FIG. 2.
Figure 6:
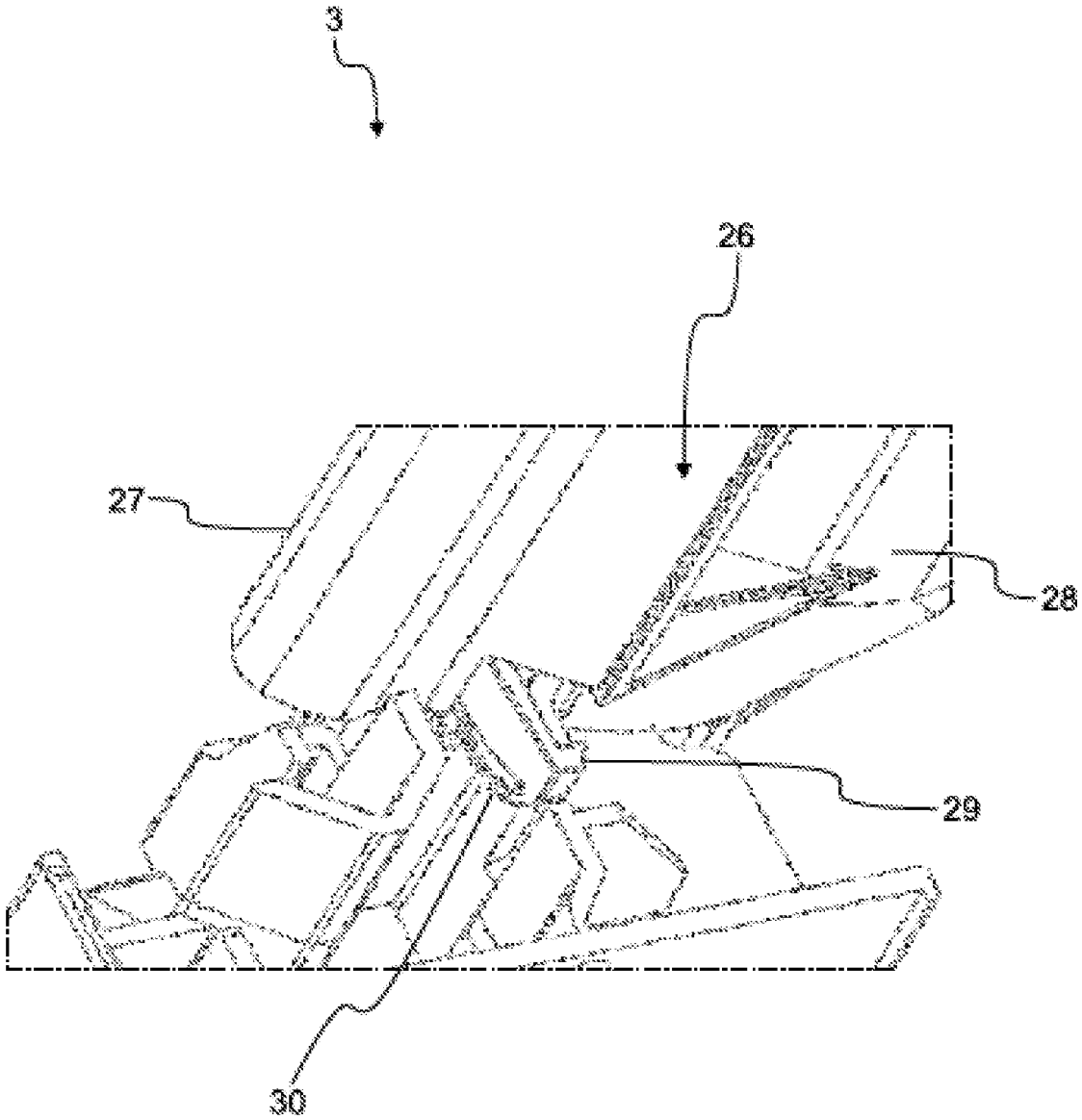
FIG. 6 shows a further schematic perspective partial view of the door according to FIG. 2.
Figure 7:
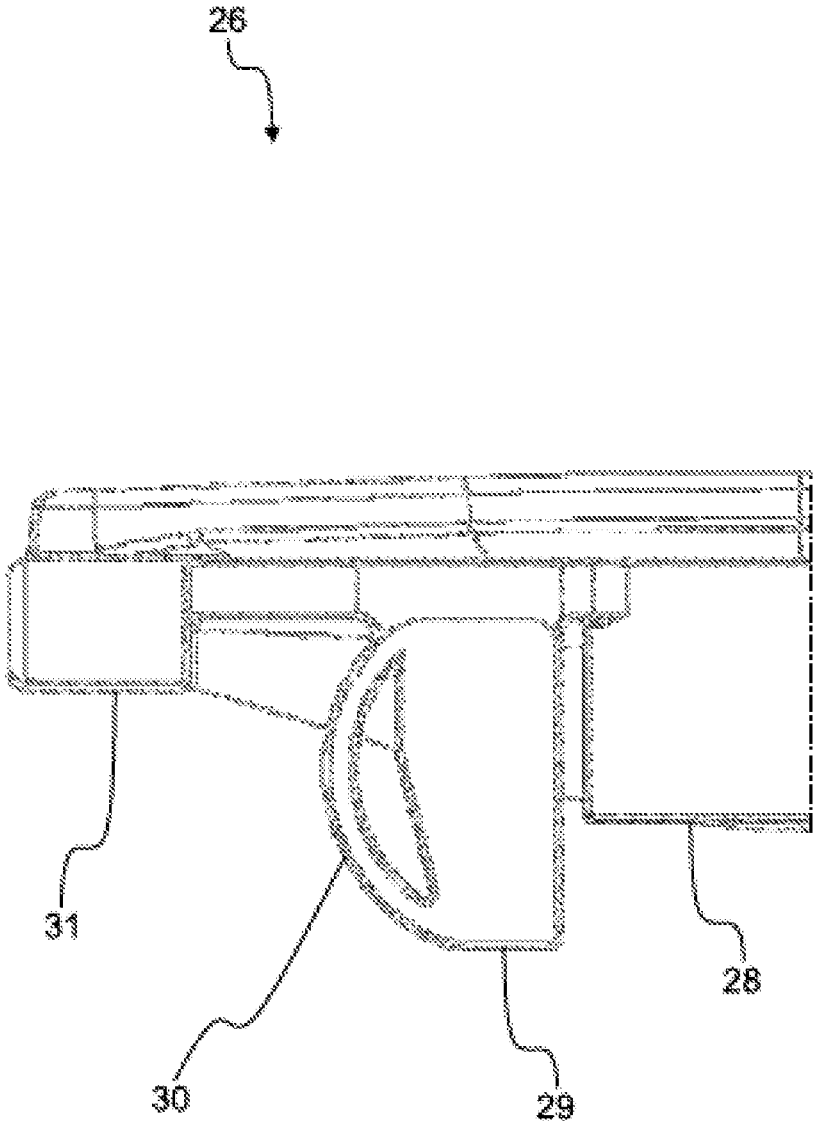
FIG. 7 shows a schematic partial view of an embodiment of a condensate collecting strip for the door according to FIG. 2.

FIG. 4 shows a schematic partial view of the door 3. FIG. 5 shows a schematic perspective partial view of the door. FIG. 6 shows a further schematic perspective partial view of the door. FIG. 7 shows a schematic view of an embodiment of a condensate collecting strip 26, as explained above. Reference is made to FIGS. 4 to 7 hereinafter at the same time.

The condensate collecting strip 26 comprises a trough-shaped or tub-shaped collecting portion 28 in which the condensed liquid F collects. A latching hook or snap hook 29 which positively engages in the door supports 18, 19 is provided on either side of the collecting portion 28. Such a snap hook 29 is assigned to each door support 18, 19. In other words, the condensate collecting strip 26 has two snap hooks 29. An elastically deformable leaf spring portion 30 is provided on each snap hook 29. By means of the leaf spring portions 30 it is possible to center the condensate collecting strip 26 between the door supports 18, 19. In particular, the leaf spring portion 30 is a tolerance-compensating element. The leaf spring portion 30 is integrally formed on the snap hook 29 at the side.

The condensate collecting strip 26 also comprises two articulated heads 31 arranged on either side of the collecting portion 28. Such an articulated head 31 is assigned to each door support 18, 19. The articulated heads 31 can be received in recesses 32 (FIG. 5) provided on the door supports 18, 19. The condensate collecting strip 26 is pivotably mounted on the door supports 18, 19 by means of the articulated heads 31. The condensate collecting strip 26 thus can be pivoted from an unlocked state, in which the snap hooks 29 are not positively engaged with the door supports 18, 19, into a locked state in which the snap hooks 29 are positively engaged with the door supports 18, 19.

The condensate collecting strip 26 is thus attached to the door supports 18,19 at the side by means of the articulated heads 31 and the snap hooks 29. During mounting, the condensate collecting strip 26 is positioned by being tilted and guided by means of the articulated heads 31 such that the snap hooks 29 are securely positioned and come into contact in a defined manner with a corresponding engagement portion 33 (FIG. 3) on the respective door support 18, 19. The engagement portion 33 can be a rib, recess or the like, provided on the respective door support 18, 19. The articulated heads 31 also have the task of deflecting condensed liquid F accumulating in the vicinity of an inner pane holder 34 (FIG. 4) such that this liquid is guided into the collecting portion 28.

The snap hooks 29 are not visible to a user and thus cannot be easily released, which for the user fulfills the objective of non-removability. This is based on the fact that an incorrect seal of the gap 23 could significantly disrupt the thermal balance of the household cooking appliance 1. For repair purposes, however, the snap hooks 29 can be elastically deformed, for example by means of a screwdriver or the like, and can be brought out of engagement with the engagement portions 33 of the door supports 18, 19, whereby the condensate collecting strip 26 can be released from the door supports 18, 19. The seal element 27 is preferably connected over the entire length thereof to the condensate collecting strip 26. As a result, the seal element 27 is prevented from sagging. Moreover, it is possible to dispense with hooking the seal element 27 into both door supports 18, 19.

Figure 8:
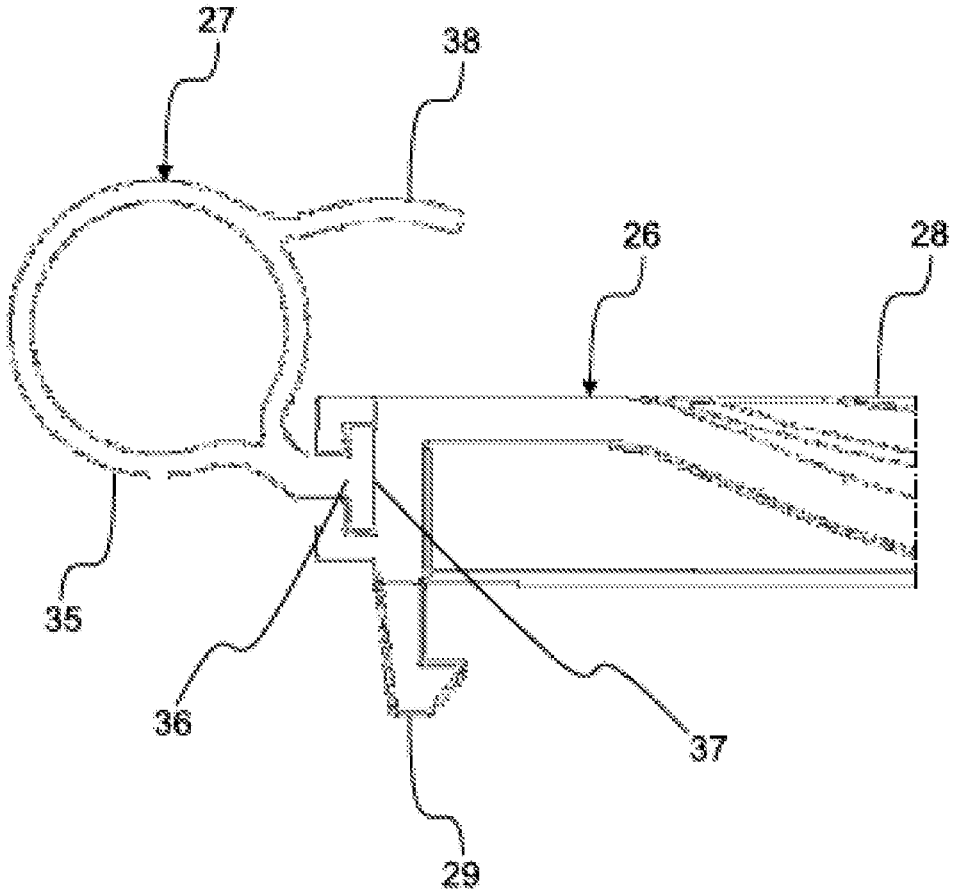
FIG. 8 shows a schematic partial sectional view of a further embodiment of a condensate collecting strip for the door according to FIG. 2.

FIG. 8 shows a schematic sectional view of a further embodiment of a condensate collecting strip 26 comprising a seal element 27. The seal element 27 has a tubular sealing portion 35 which is pressed between the inner pane 20 and the second intermediate pane 22. Moreover, the seal element 27 comprises a T-shaped engagement portion 36 which positively engages in a corresponding counter-engagement portion 37 of the condensate collecting strip 26 in a positive manner. In particular, the counter-engagement portion 37 is a groove. For connecting the seal element 27 to the condensate collecting strip 26, the engagement portion 36 is pulled into the counter-engagement portion 37 at the side. A sealing lip 38 extending out of the sealing portion 35 can be provided thereon.

Alternatively, the seal element 27 can be clipped into the condensate collecting strip 26 with an integrally formed film hinge and snap pins. Moreover, the seal element 27 can also be clipped into the condensate collecting strip 26 by means of additional elements, for example made of sheet steel, wire or plastics. Moreover, it is possible to provide additional elements, such as for example clamps, which are pushed over a connecting point between the seal element 27 and the condensate collecting strip 26 and pressed further, as required.

Figure 9:
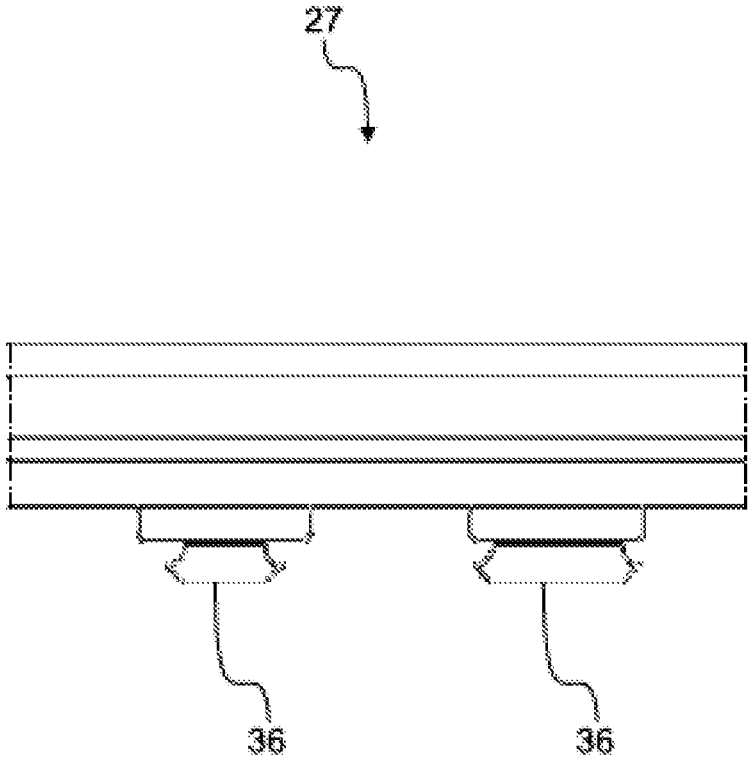
FIG. 9 shows a schematic partial view of an embodiment of a seal element for the door according to FIG. 2.

FIG. 9 shows a schematic partial view of a further embodiment of a seal element 27. In this embodiment of the seal element 27 it comprises a plurality of engagement portions 36 in the form of latching lugs, which are pushed into corresponding counter-engagement portions of the condensate collecting strip 26.

Figure 10:
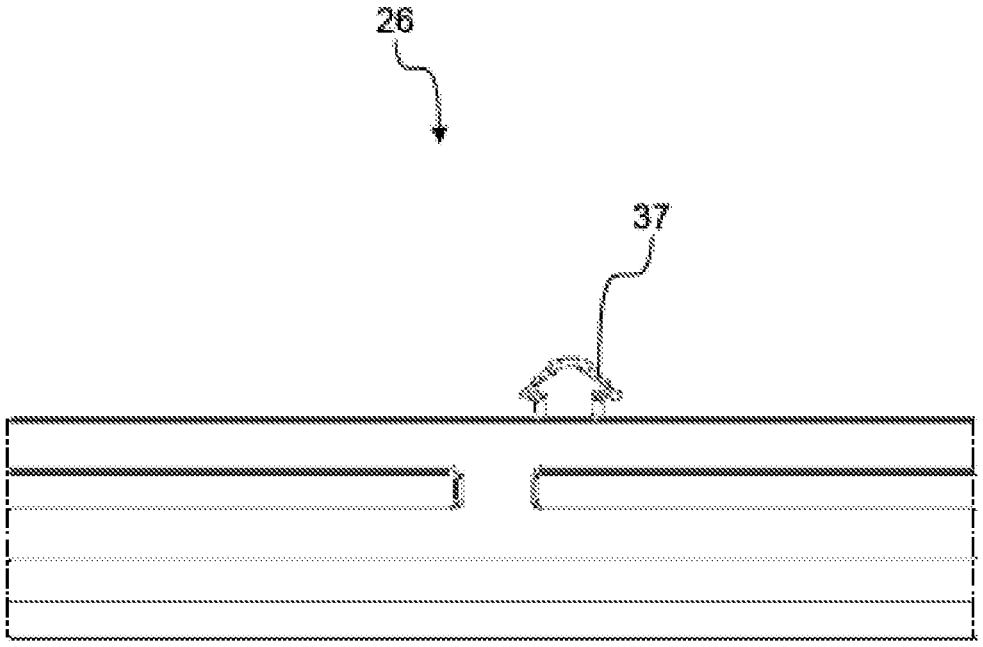
FIG. 10 shows a schematic partial view of a further embodiment of a condensate collecting strip for the door according to FIG. 2.

FIG. 10 shows a schematic partial view of a further embodiment of a condensate collecting strip 26. In this embodiment of the condensate collecting strip 26 it comprises a counter-engagement portion 37 in the form of a pin which is pushed into a corresponding engagement portion, for example in the form of a recess, of the seal element 27.

Figure 11:
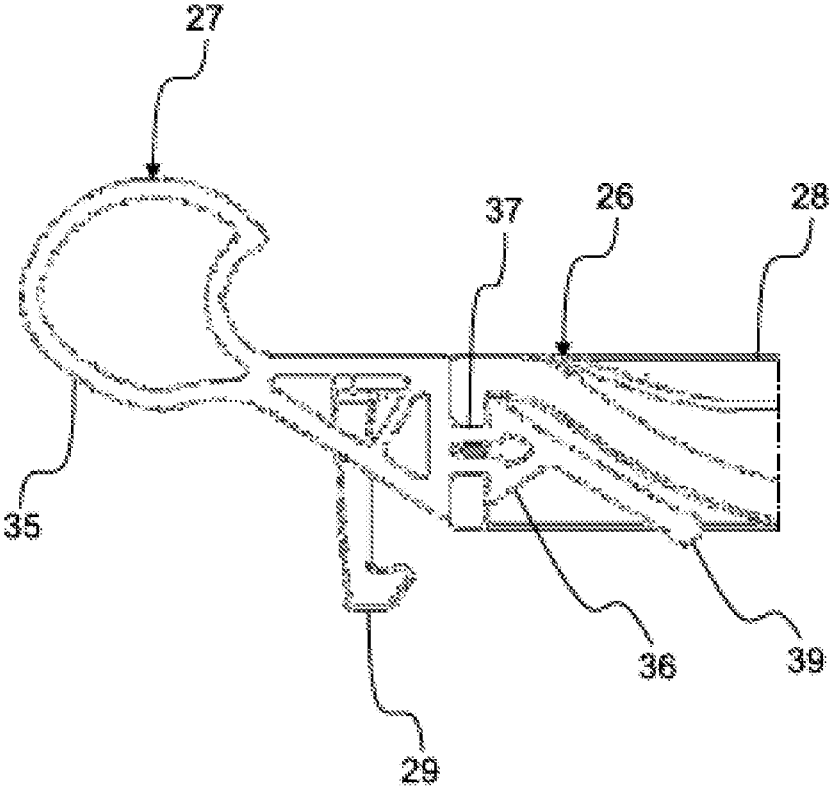
FIG. 11 shows a schematic partial sectional view of a further embodiment of a condensate collecting strip for the door according to FIG. 2.

FIG. 11 shows a schematic partial sectional view of a further embodiment of a condensate collecting strip 26 comprising a seal element 27. In this case, counter-engagement portions 37 in the from of recesses are provided on the condensate collecting strip 26. The seal element 27 has an engagement portion 36 corresponding thereto which positively engages in the counter-engagement portion 37. An actuating portion 39 can be provided on the engagement portion 36. The engagement portion 36 can be pulled through the counter-engagement portion 37 by means of the actuating portion 39, wherein the engagement portion 36 is elastically deformed and engages behind the counter-engagement portion 37. In this case, the seal element 27 comprises any number of engagement portions 36. Accordingly, the condensate collecting strip 26 also comprises a plurality of counter-engagement portions 37 corresponding thereto.

Alternatively, the seal element 27 can be directly injection-molded in a multi-component injection-molding method onto the condensate collecting strip 26. In this case, the seal element 27 is designed as a flexible component and the condensate collecting strip 26 as a hard component. The flexible component can be, for example, a thermoplastic elastomer (TPE), in particular a thermoplastic polyurethane (TPU). The hard component can be, for example, an acrylonitrile butadiene styrene (ABS) or a different suitable plastics material.

Figure 12:
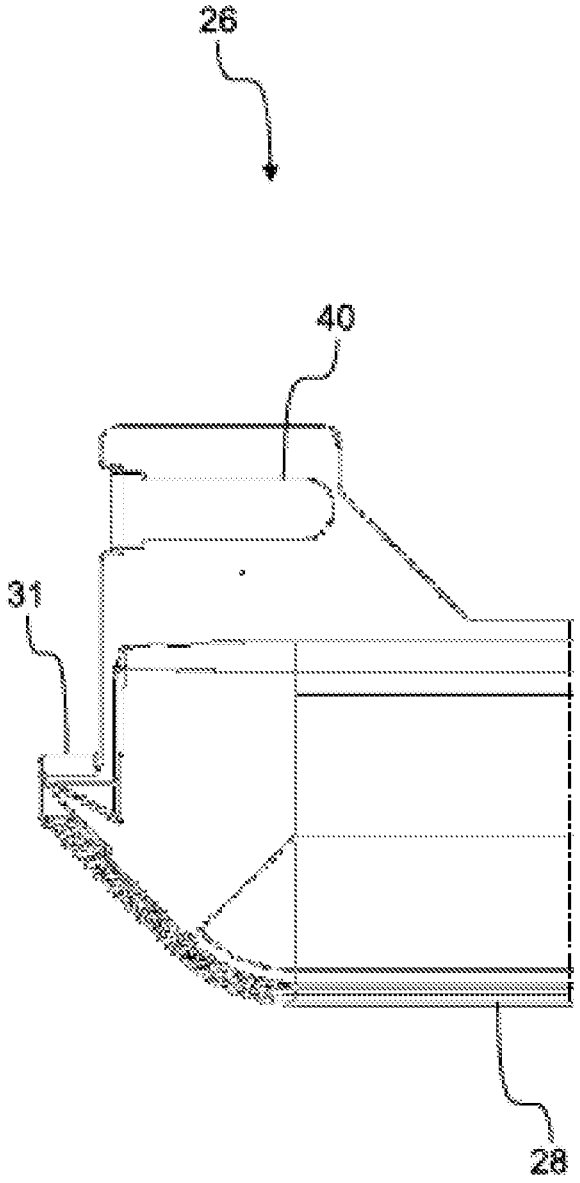
FIG. 12 shows a schematic partial view of a further embodiment of a condensate collecting strip for the door according to FIG. 2.

FIG. 12 shows a schematic partial view of a further embodiment of a condensate collecting strip 26. In this case, the seal element 27 comprises hooks 40 which are adhesively bonded into the seal element 27. The hooks 40 are hooked into the condensate collecting strip 26 at the side. In this case, a pretensioning of the seal element 27 is required.

Figure 13:
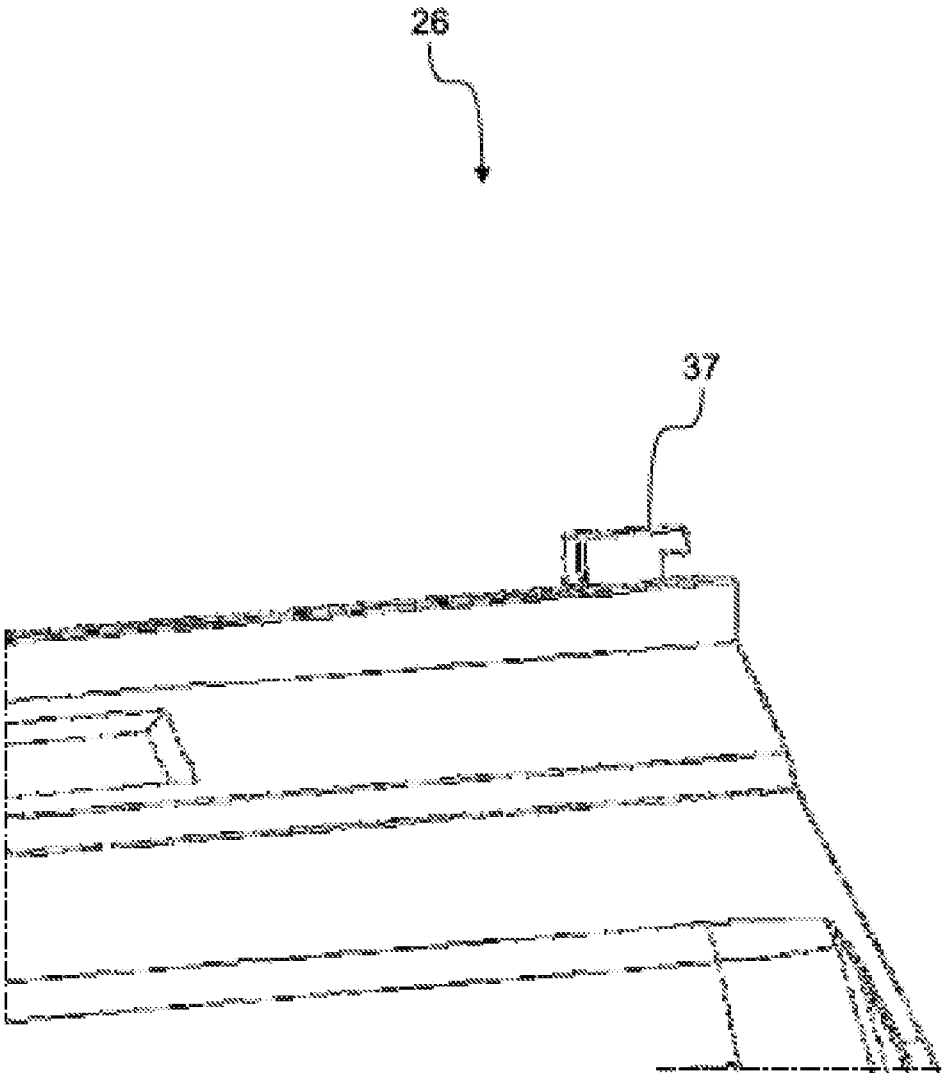
FIG. 13 shows a schematic perspective partial view of a further embodiment of a condensate collecting strip for the door according to FIG. 2.

FIG. 13 shows a schematic perspective partial view of a further embodiment of a condensate collecting strip 26. In this embodiment of the condensate collecting strip 26 it encompasses lateral counter-engagement portions 37 in the form of hooks. Preferably, two such counter-engagement portions 37 are provided into which the seal element 27 is hooked. A pretensioning of the seal element 27 is also required here.

Figure 14:
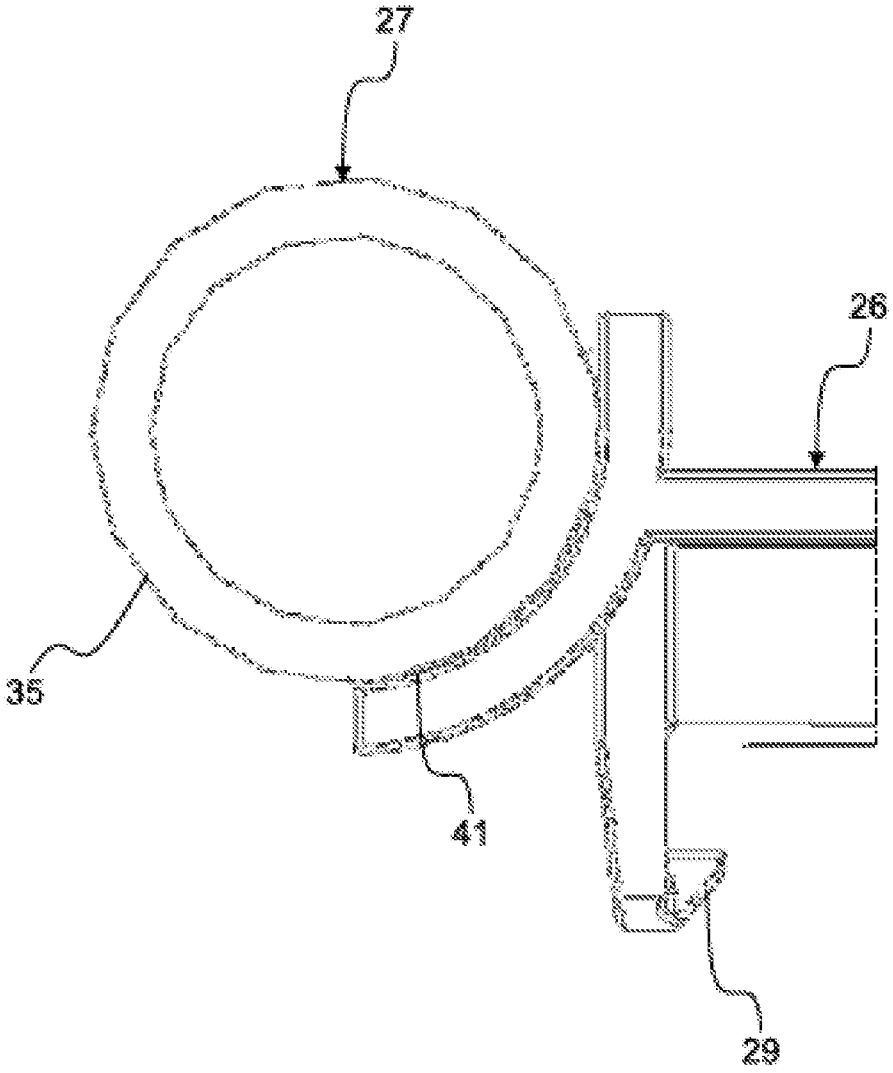
FIG. 14 shows a schematic partial sectional view of a further embodiment of a condensate collecting strip for the door according to FIG. 2.

FIG. 14 shows a schematic partial sectional view of a further embodiment of a condensate collecting strip 26 comprising a seal element 27. In this case, a receiving portion 41 for receiving the seal element 27 is provided on the condensate collecting strip 26. The seal element 27 can be positively held by the receiving portion 41. Additionally, the seal element 27 can be hooked into the condensate collecting strip 26 at the side. The receiving portion 41 thus provides the seal element 27 with a support over the entire length thereof.

Figure 15:
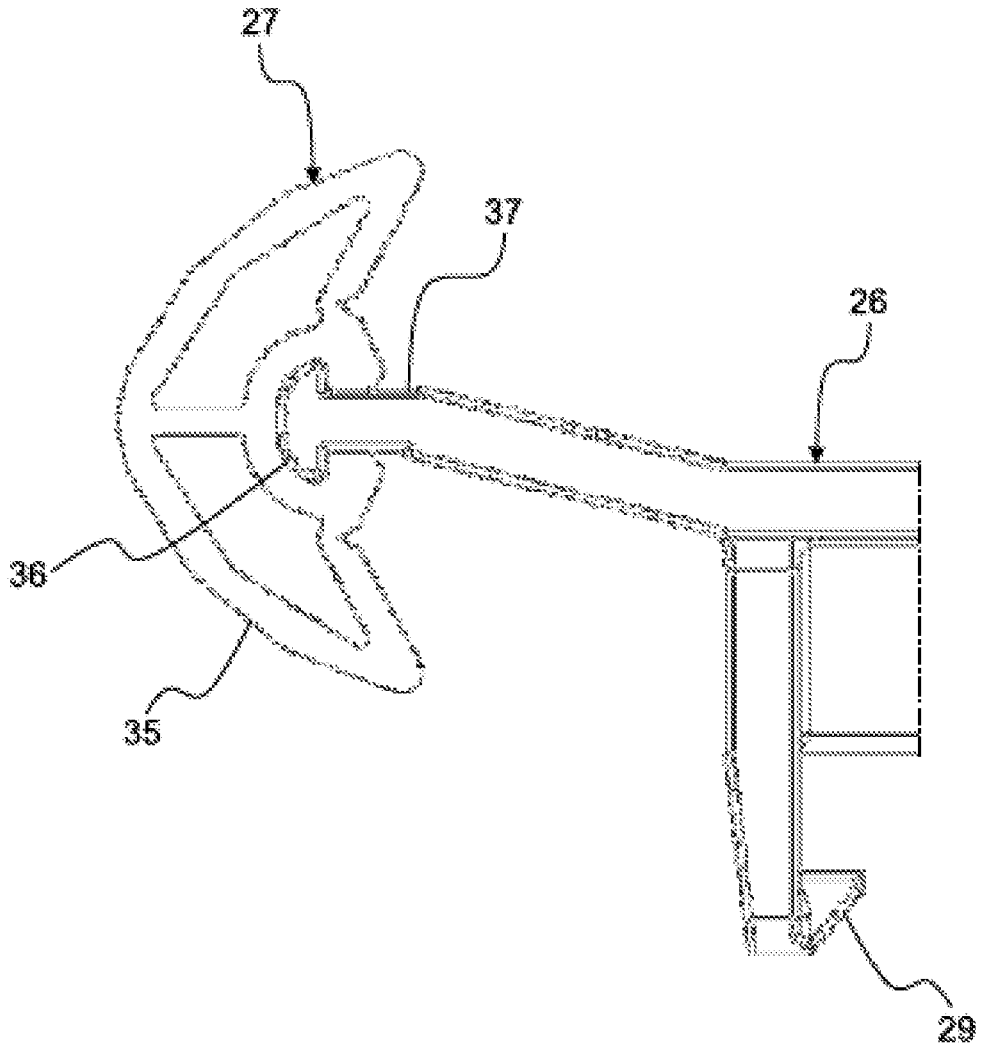
FIG. 15 shows a schematic partial sectional view of a further embodiment of a condensate collecting strip for the door according to FIG. 2.

FIG. 15 shows a schematic partial sectional view of a further embodiment of a condensate collecting strip 26 comprising a seal element 27. The seal element 27 comprises a T-shaped engagement portion 36 which is pushed onto a T-shaped counter-engagement portion 37 of the condensate collecting strip 26 at the side. The seal element 27 comprises a sealing portion 35 which is arrow-shaped or mushroom-shaped in cross section.

Alternatively, the seal element 27 can also be provided with punched-out portions and inserted into the condensate collecting strip 26 and hot-caulked therewith. The condensate collecting strip 26 contains corresponding domes, ribs or similar projections therefor. For fixing inside the condensate collecting strip 26, in particular the counter-engagement portion 37, a wire or flat profile made of plastics or metal can be threaded into the seal element 27.

Depending on the type of attachment of the seal element 27 to the condensate collecting strip 26, the non-removability of the seal element 27 can be ensured by elements integrally formed on the door supports 18, 19. The elements can comprise ribs or lugs which are attached in a removal direction to the door support 18, 19 which adjoins the condensate collecting strip 26 and prevents a release of the seal element 27 by the removal direction being blocked. This is preferably able to be implemented for applications in which the seal element 27 has to be released from the ends of the condensate collecting strip 26, wherein the removal direction corresponds to a longitudinal direction of the condensate collecting strip 26.

Figure 16:
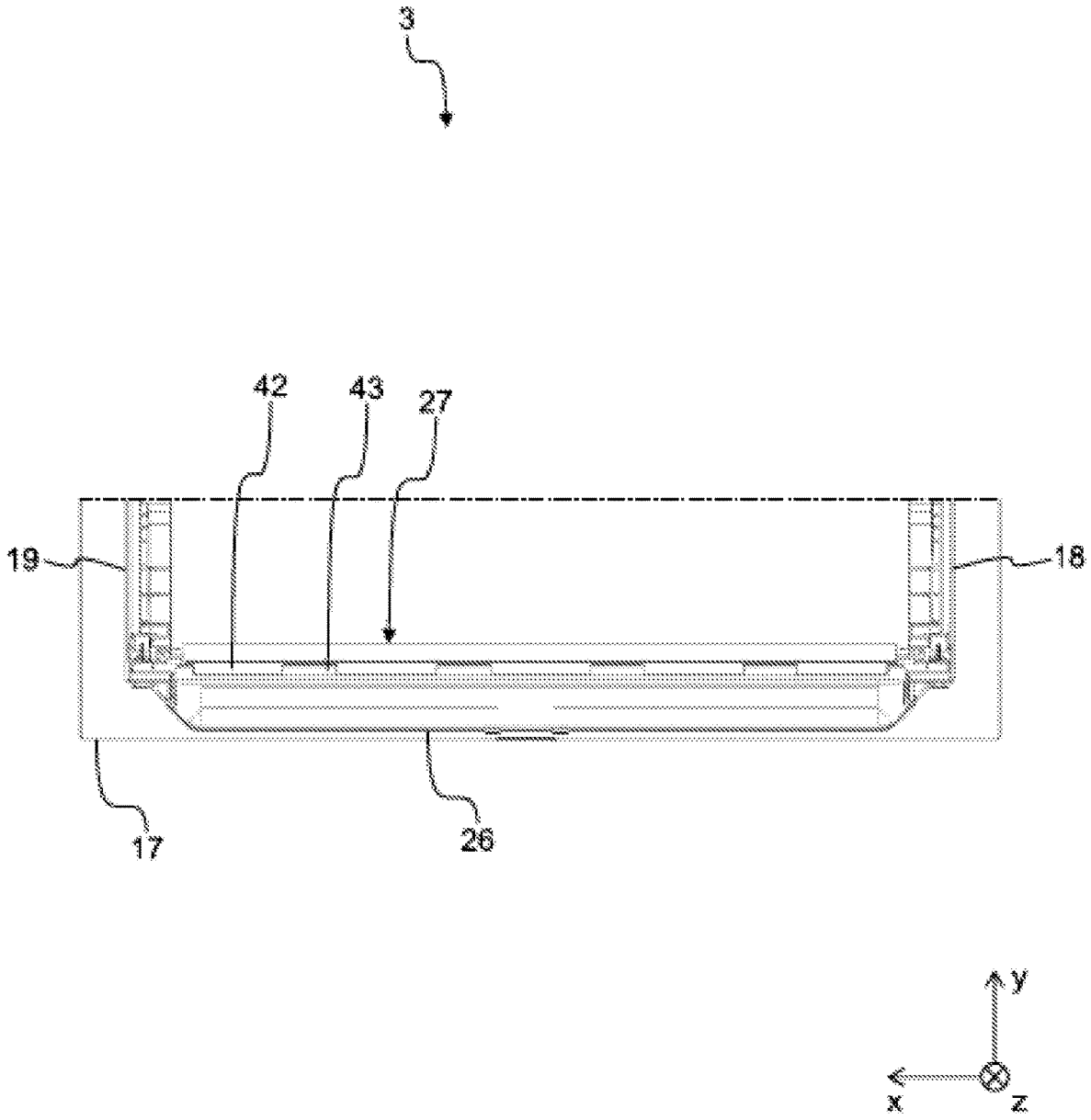
FIG. 16 shows a schematic partial view of a further embodiment of a door for the household cooking appliance according to FIG. 2.

FIG. 16 shows a schematic partial view of a further embodiment of a door 3. In this embodiment of the door 3 the seal element 27 comprises spacers 42, only one thereof being provided with a reference sign in FIG. 16. In cooperation with the condensate collecting strip 26, in the mounted state of the seal element 27 ventilation slots 43 are produced, only one thereof being provided with a reference sign in FIG. 16. A cooling of the condensate collecting strip 26 can be implemented by means of the ventilation slots 43. The condensate collecting strip 26 is thus cooled by circulating air.

As the seal element 27 is connected to the condensate collecting strip 26, and the seal element 27 and the condensate collecting strip 26 thus form a common subassembly, a simplified mounting is possible. It is possible for said subassembly to be replaced in a simple manner by the after-sales service or in the case of repair. A self-locating centering is implemented by means of the leaf spring portions 30. The attachment at the side also permits a collection of the condensed liquid F on the inner pane holder 34 adjacent to the condensate collecting strip 26 by a suitable deflection of the liquid F. It is no longer able to be removed by the user, whereby incorrect mounting or loss is prevented. The support of the seal element 27 over the entire length thereof prevents displacement, twisting or sagging and thus ensures a secure seal of the gap 23. Depending on the type of attachment of the seal element 27 to the condensate collecting strip 26, the seal element 27 can be mounted without pretensioning. In particular when using silicone, a relaxation of the silicone and thus sagging of the seal element 27 can be prevented hereby.

Although the present invention has been described with reference to exemplary embodiments, it can be modified in many different ways.

The invention claimed is:

1. A door for a household cooking appliance, said door comprising:

an outer pane;

an inner pane;

a condensate collecting strip provided on a lower edge of the door for collecting a liquid condensed on the inner pane;

an intermediate pane arranged between the outer pane and the inner pane, wherein a gap is provided between opposing surfaces of the intermediate pane and the inner pane, the opposing surfaces of the intermediate pane and the inner pane arranged substantially parallel to one another and spaced apart from one another; and a seal element arranged at least in one portion in the gap between the opposing surfaces of the intermediate pane and the inner pane, the seal element sealing the gap between the opposing surfaces, said seal element being positively or materially connected exclusively to the condensate collecting strip.

2. The door of claim 1, wherein the seal element comprises an engagement portion which positively engages in a corresponding counter-engagement portion of the condensate collecting strip.

3. The door of claim 1, wherein the seal element is hooked into the condensate collecting strip at a side thereof.

4. The door of claim 1, wherein the seal element is injection-molded onto the condensate collecting strip by a multi-component injection-molding method.

5. The door of claim 1, wherein the condensate collecting strip supports the seal element over an entire length thereof.

6. The door of claim 1, further comprising:

a second intermediate pane, wherein the intermediate pane and the second intermediate pane are arranged between the outer pane and the inner pane, wherein the second intermediate pane is arranged between the outer pane and the intermediate pane, and wherein the intermediate pane is arranged between the inner pane and the second intermediate pane.

7. The door of claim 6, wherein the seal element is pressed between the inner pane and the intermediate pane.

8. The door of claim 1, further comprising a door support which bears the outer pane, said condensate collecting strip being positively connected to the door support.

9. The door of claim 8, wherein the condensate collecting strip comprises a snap hook which positively engages in the door support.

10. The door of claim 9, wherein the snap hook comprises an elastically deformable leaf spring portion.

11. The door of claim 1, further comprising:

a first door support; and a second door support, wherein the condensate collecting strip is arranged between the first door support and the second door support.

12. The door of claim 1, wherein the seal element is pressed between the intermediate pane and the inner pane.

13. The door of claim 1, wherein the seal element is elastically deformed between the intermediate pane and the inner pane.

14. The door of claim 1, wherein the seal element comprises a sealing portion, wherein the sealing portion comprises a tubular cross-section, an arrow-shaped cross section, or a mushroom-shaped cross section, and wherein the sealing portion is pressed between the intermediate pane and the inner pane.

15. The door of claim 14, wherein the seal element comprises a sealing lip extending out from the sealing portion.

16. A door for a household cooking appliance, said door comprising:

an outer pane;

an inner pane;

a condensate collecting strip provided on a lower edge of the door for collecting a liquid condensed on the inner pane;

a seal element arranged at least in one portion in a gap between the outer pane and the inner pane, said seal element being positively or materially connected exclusively to the condensate collecting strip, and a door support which bears the outer pane, said condensate collecting strip being positively connected to the door support, wherein the condensate collecting strip comprises a snap hook which positively engages in the door support, and wherein the condensate collecting strip comprises an articulated head about which the condensate collecting strip is pivotably mounted on the door support so that the condensate collecting strip is pivotable from an unlocked state, in which the snap hook is not positively engaged with the door support, into a locked state in which the snap hook is positively engaged with the door support.

17. A household cooking appliance, comprising:

a cooking chamber; and a door attached to the cooking chamber, said door comprising an outer pane, an inner pane, a condensate collecting strip provided on a lower edge of the door for collecting a liquid condensed on the inner pane, and a seal element arranged at least in one portion in a gap between the outer pane and the inner pane, said seal element being positively or materially connected exclusively to the condensate collecting strip, wherein the door comprises a door support which bears the outer pane, said condensate collecting strip being positively connected to the door support, wherein the condensate collecting strip comprises a snap hook which positively engages in the door support, and wherein the condensate collecting strip comprises an articulated head about which the condensate collecting strip is pivotably mounted on the door support so that the condensate collecting strip is pivotable from an unlocked state, in which the snap hook is not positively engaged with the door support, into a locked state in which the snap hook is positively engaged with the door support.

18. The household cooking appliance of claim 17, wherein the seal element comprises an engagement portion which positively engages in a corresponding counter-engagement portion of the condensate collecting strip.

19. The household cooking appliance of claim 17, wherein the door comprises an intermediate pane arranged between the outer pane and the inner pane, said gap being provided between the intermediate pane and the inner pane.

20. The household cooking appliance of claim 19, wherein the seal element is pressed between the intermediate pane and the inner pane.

* * * * *